US008461438B2

(12) United States Patent
LeBlanc et al.

(10) Patent No.: US 8,461,438 B2
(45) **Date of Patent: *Jun. 11, 2013**

(54) HARP STAND AND METHODS OF USE THEREOF

(76) Inventors: Gaye LeBlanc, Norman, OK (US); David Steffens, Oklahoma City, OK (US); Michael K. Stewart, II, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,301

(22) Filed: Aug. 8, 2011

(65) Prior Publication Data

US 2011/0290095 A1 Dec. 1, 2011

Related U.S. Application Data

(63) Continuation of application No. 12/615,929, filed on Nov. 10, 2009, now Pat. No. 7,994,407.

(51) Int. Cl.
*G10D 1/04* (2006.01)

(52) U.S. Cl.
USPC ..... 84/264

(58) Field of Classification Search
USPC ..... 94/173, 264–266
See application file for complete search history.

(56) References Cited

U.S. PATENT DOCUMENTS

2006/0236842 A1* 10/2006 Yu ..... 84/327
2010/0107852 A1 5/2010 Stevens
2011/0107896 A1* 5/2011 LeBlanc et al. ..... 84/327

* cited by examiner

*Primary Examiner* — Kimberly Lockett
(74) *Attorney, Agent, or Firm* — Hall Estill Law Firm

(57) ABSTRACT

A harp support assembly is provided for supporting a portion of a harp. The harp support assembly includes a rod, a base assembly and a harp support member. The rod has a first and a second end. The base assembly is positioned near the first end of the rod, The base assembly has a plurality of legs spread apart and positioned on a surface. The harp support member is positioned near the second end of the rod. The harp support member has at least one support arm providing a harp receiving space to receive the harp.

20 Claims, 9 Drawing Sheets

HARP STAND AND METHODS OF USE THEREOF

CROSS-REFERENCE TO RELATED APPLICATIONS

The present application is a continuation of U.S. application Ser. No. 12/615,929, filed Nov. 10, 2009, now U.S. Pat. No. 7,994,407 which is hereby expressly incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates generally to a harp stand or support, and more particularly, not by way of limitation, to an improved harp stand or harp support assembly for maintaining a harp in a playable position.

2. Brief Description of the Prior Art

When playing a harp, a harpist is seated behind the body/soundboard of the harp. The harp body is leaned or angled back toward the harpist and rested against the harpist's shoulder. Typically, conventional harps can weigh between 75 and 90 pounds. The weight of the harp against the shoulder of the harpist over a period of years, when practicing and performing, can take a toll on the body of the harpist by causing muscle and/or nerve damage to the shoulder or damage to other body parts of the harpist.

To this end, to alleviate the weight of the harp from the shoulder of the harpist, a harp support assembly is provided which functions to enhance the use of the harp and to maintain and improve the health of the body of a harpist over years of playing the harp. It is to such a harp support assembly that the present invention is directed.

DETAILED DESCRIPTION OF THE INVENTION

Figure 1:
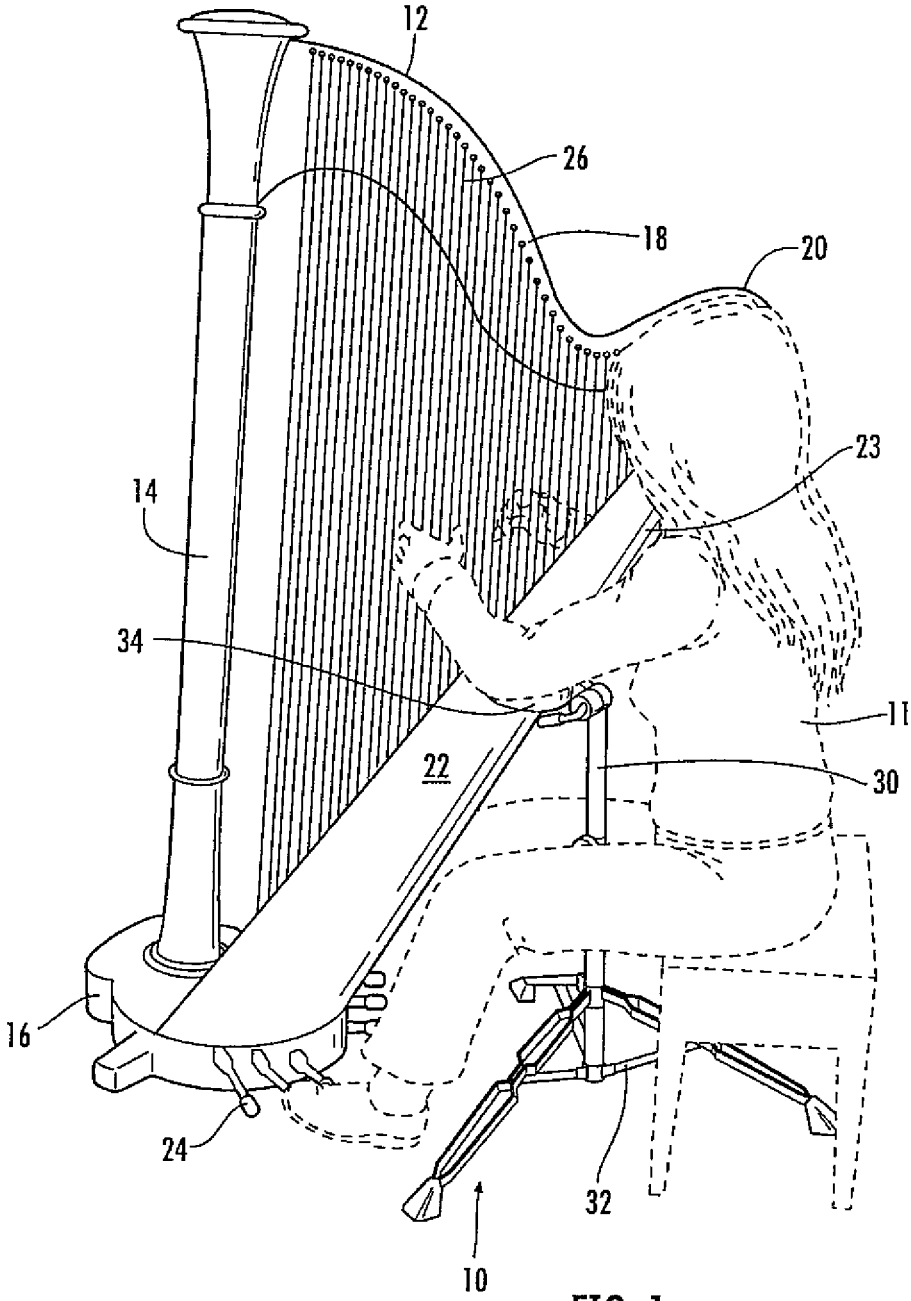
FIG. 1 is a perspective view of a harp support assembly constructed in accordance with the present invention in use supporting a harp being played by a harpist.

Referring now to the drawings, and more particularly to FIG. 1, shown therein is a harp support assembly 10 constructed in accordance with the present invention in use by a harpist 11 playing a conventional pedal harp 12. The conventional harp 12 includes a column 14, a base 16, a neck 18, a knee 20, a body 22, openings 23, pedals 24 and strings 26. It should be understood by one of ordinary skill in the art that the harp support assembly 10 may be utilized with a variety of different harps so long as the harp support assembly functions in accordance with the present invention. In the present embodiment, the harp support assembly 10 is positioned in front of the harpist 11 as seated and behind the body 22 of the harp 12. However, it should be understood that the harp support assembly 10 may be positioned about the harp 12 in a variety of ways so long as the harp support assembly 10 supports the harp 12 and functions in accordance to the present invention as described herein.

It is contemplated that the harp support assembly 10 is constructed from various components, however, it should be understood that the harp support assembly 10 may be constructed from various components or from one solid piece of material. The harp support assembly 10 is preferably made of a durable and rigid material which is strong enough to support the weight of a harp. Suitable materials for construction of the harp support assembly 10 and components thereof include polymeric materials, plastics, metals such as aluminum, steel, titanium, magnesium or alloys containing these metals, composite materials, various wood(s) and the like which are capable of providing the desired strength and durability for the harp support assembly 10.

Figure 2:
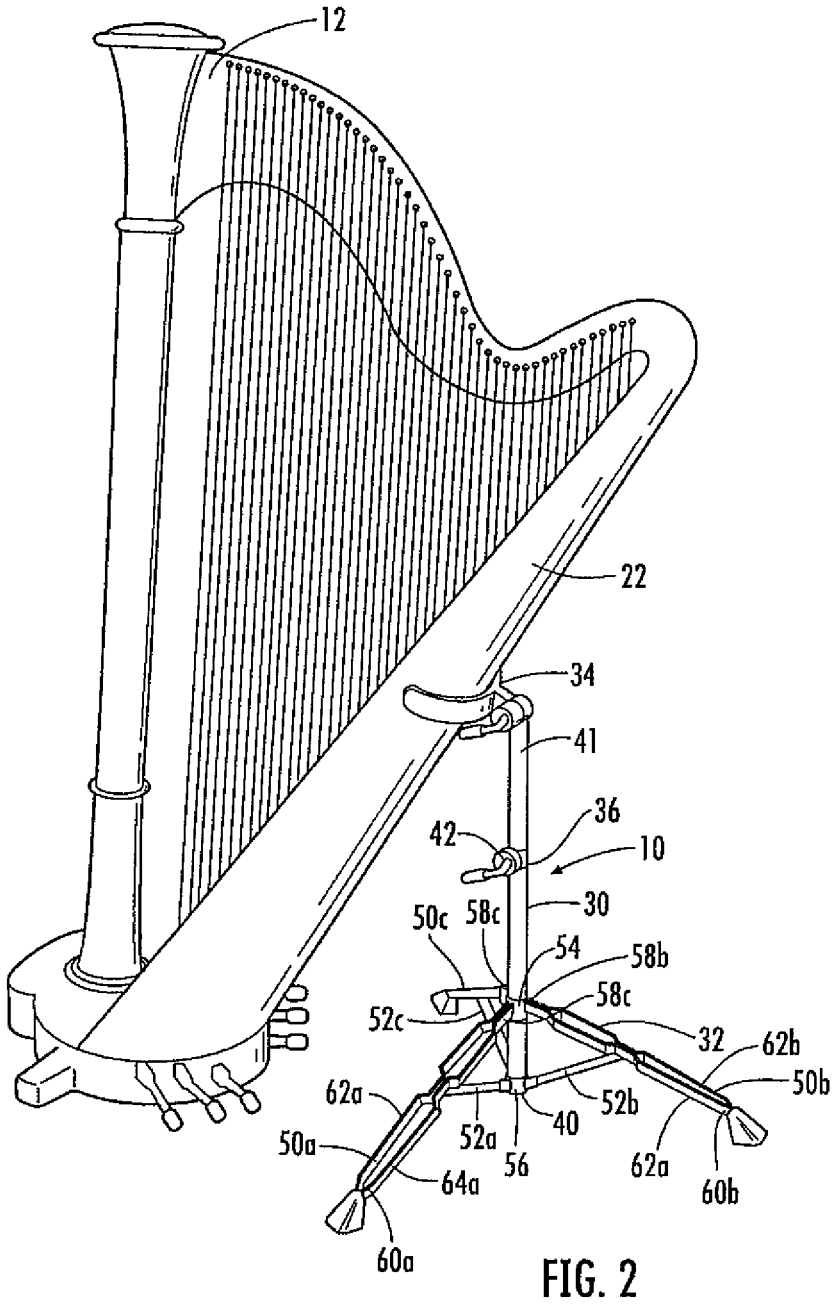
FIG. 2 is a perspective view of the harp support assembly of FIG. 1.
Figure 3:
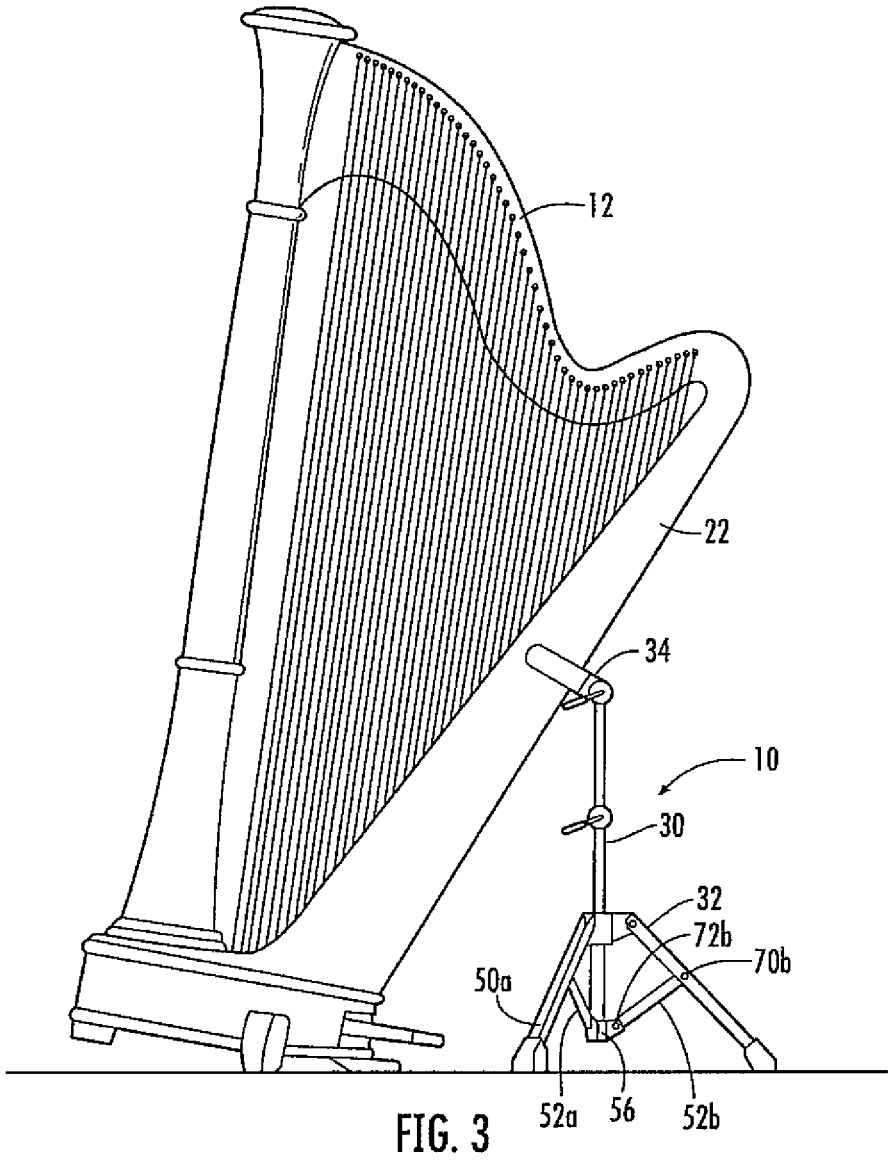
FIG. 3 is a perspective view of the harp support assembly of FIG. 1, the harp support assembly shown supporting the harp in an angled position.

Referring now to FIGS. 1-3, broadly, one embodiment of, the harp support assembly 10 includes a post assembly 30, a base assembly 32 and a harp support member 34. It is contemplated that the harp support assembly 10 is constructed from various components, however, it should be understood that the harp support assembly 10 may be constructed from one solid piece of material. Further, it should be understood that each of the components of the harp support assembly 10 may be detachably connected to one another.

The post assembly 30 includes a post 36 having a first end 38 and a second end 40. An extension member 41 is telescopingly connected to the post 36 at the first end 38, however, it should be understood by one of ordinary skill in the art that the extension member 41 may be connected to the post 36 by any means known in the art for connecting one item to another. The extension member 41 is telescopically received by the post 36 and is telescopically extended to the desired length selected by the harpist 11 by a connector 42. The extension member 41 is adjustable to various heights as desired by the harpist 11.

The base assembly 32 is positioned near the second end 40 of the post 36 of the post assembly 30. The base assembly 32 is positioned on a support surface, such as the ground, a stage, etc. The base assembly 32 includes a plurality of legs 50 (50*a*, 50*b*, and 50*c*), a plurality of arms 52 (52*a*, 52*b* and 52*c*), a first attachment member 54 and a second attachment member 56. Each of the plurality of legs 50 has a first end 58, a second end 60, and a first portion 62 and a second portion 64 provided in a substantially eight-shaped configuration. Each first end 58 of each of the plurality of legs 50 are connected to the first attachment member 54 in a tripod configuration. Although it should be understood by one of ordinary skill in the art that the plurality of legs 50 may be provided in any number and any variety of configurations, such as square, rectangular, circular, and the like, so long as the plurality of legs 50 functions in accordance with the present invention as described herein. The base assembly 32 is adjustable to various heights as desired by the harpist 11. The first attachment member 54 is disposed about the post 36 and axially positions and simultaneously attaches each of the plurality of legs 50 to the post 36.

The first attachment member 54 is joined with the first end 58 of each of the plurality of legs 50 by respective pivot pins, such that each of plurality of legs 50 can pivot freely inwardly and outwardly with respect to the post 36. The first attachment member 54 is disposed about the post 36 and is capable of being moved along and about the post 36 allowing the spread of each of the plurality of legs 50 and also enables the plurality of legs 50 to be folded inward after use of the harp support assembly 10. A connector is provided between the first attachment member 54 and the post 36 for adjusting and fixing the first attachment member 54 to the post 36.

One end 70 (70*a*, 70*b* and 70*c*) of each of the plurality of arms 52 is pivotally connected to a portion of a corresponding leg 50 of the plurality of legs 50. The other end 72 (72*a*, 72*b*, 72*c*) of each of the plurality of arms 52 is pivotally connected to the second attachment member 56 with a pin. The second attachment member 56 which is disposed about the post 36 axially positions each of the plurality of arms 52 to the post 36 with the first attachment member 54 and each of the plurality of legs 50 which corresponds to each of the plurality of arms 52. The second attachment member 56 is capable of being slid along the post 36.

Figure 4:
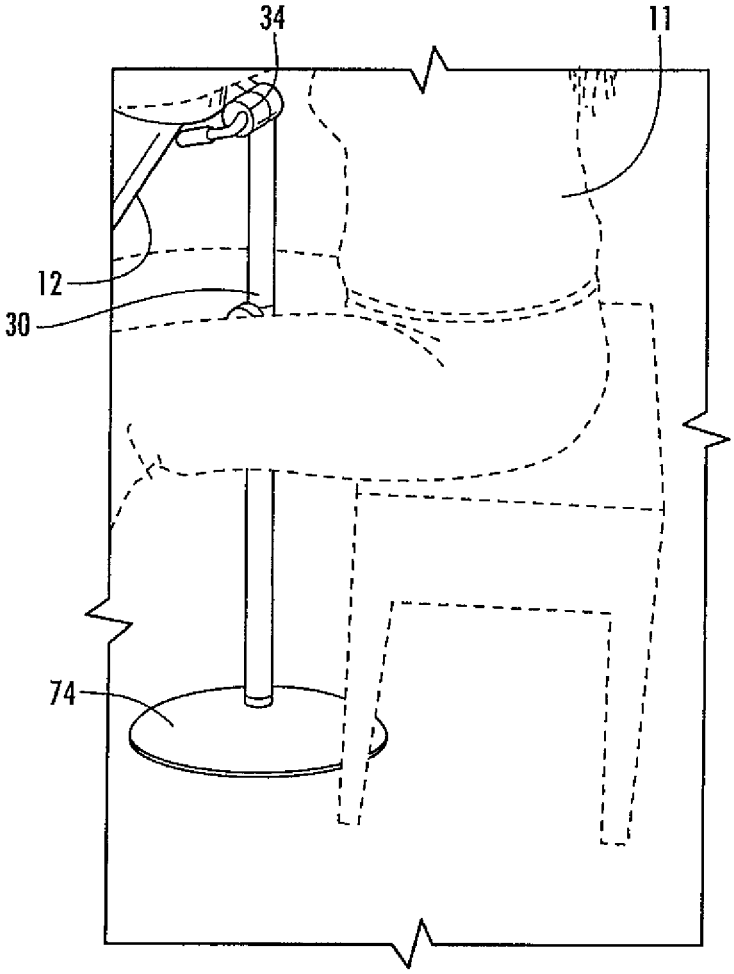
FIG. 4 is another embodiment of a base assembly of the harp support assembly.
Figure 5:
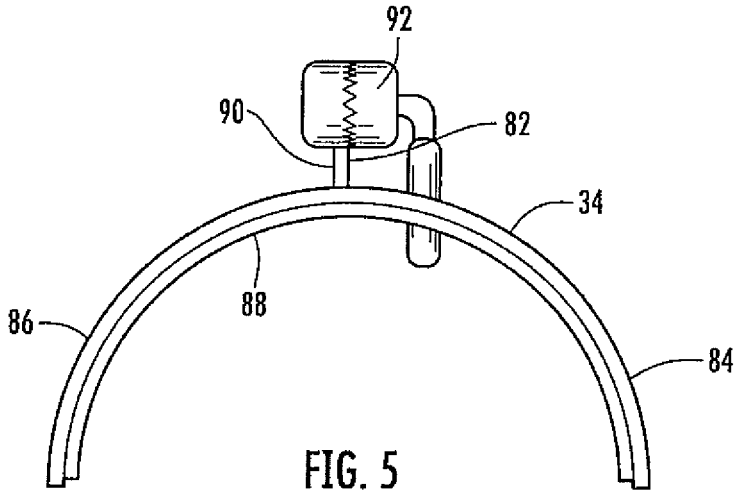
FIG. 5 is a top view of one embodiment of a harp support member of the harp support assembly of FIG. 1.

Referring to FIG. 4, the harp support assembly 10*b* is shown which is similar to the harp support assembly 10 except that a base assembly 74 is provided having a conventional rounded base.

Referring now to FIGS. 1-3 and 5, the harp support member 34 is shown wherein the harp support member 34 is provided with one end 82 that includes a first support arm 84 and a second support arm 86 in a substantially spaced apart semi-circular-shaped configuration which provides a harp receiving space 88. It should be understood by one of ordinary skill in the art that although the harp support member 34 is shown in a semi-circular shape, any shape may be utilized for receiving the harp 12, such as u-shaped, v-shaped, semi-spherical, semi-triangular, semi-square and the like, so long as the configuration of the harp support member 34 functions in accordance with the present invention as described herein. The first and second support arms 84 and 86 of the harp support member 34 may be coated or made from rubber or some other elastomeric material which allows the harp support member 80 to come in contact with the harp 12 without damaging the harp 12. The harp support member 34 is provided with a shank 90 which connects the harp support member 34 to the extension member 41. The harp support member 34 is pivotal in a first direction and an opposing second direction such that the harp receiving space 88 may receive the harp 12 and so that the harp 12 is capable of being selectively received at various positions along the body 22 of the harp 12. The harp support member 34 is fixed in the desired position by a connector 92.

Figure 6:
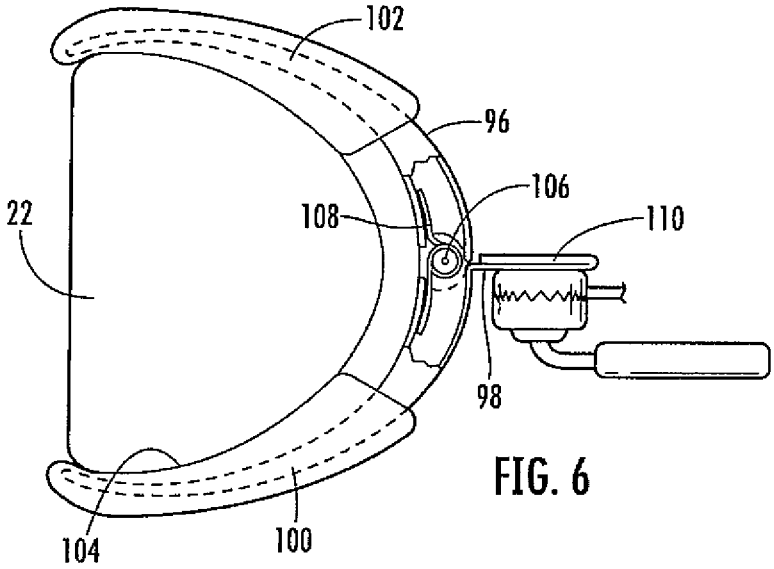
FIG. 6 is a top view of another embodiment of a harp support member.

In FIG. 6, another embodiment of a harp support member 96 is shown wherein the harp support member 96 is provided with one end 98 that includes a first gripping arm 100 and a second gripping arm 102 in a substantially spaced apart u-shaped configuration which provides a harp receiving space 104. It should be understood by one of ordinary skill in the art that although the harp support member 96 is shown in a u shape, any shape may be utilized for receiving the harp 12, such as semi-circular shaped, v-shaped, semi-spherical, semi-triangular, semi-square and the like, so long as the configuration of the harp support member 96 functions in accordance with the present invention as described herein. Further, it should be understood by one of ordinary skill in the art that although the harp support member 96 is shown having a first gripping arm 100 and a second gripping arm 102, the harp support member 96 may include a single gripping member or a plurality of gripping members connected to the harp support member 96 or a portion of each of the first and second gripping arms 100 and 102, such as prongs, extensions or the like, for additional support for holding the harp. The first and second gripping arms 100 and 102 are pivotal about a pivot pin 106. A biasing member 108 is positioned about the pivot pin 106 and acts to bias the first and second gripping arms 100 and 102 so that the first and second gripping arms 100 and 102 are positioned into a configuration to grip the harp 12 when positioned in the harp receiving space 104. The first and second gripping arms 100 and 102 of the harp support member 96 may be coated or made from rubber or some other elastomeric material which allows the harp support member 80*b* to come in contact with the harp 12 without damaging the harp 12. The harp support member 96 is provided with a shank 110 which connects the harp support member 96 to the extension member 41. The harp support member 96 is pivotal in a first direction and an opposing second direction such that the harp receiving space 104 may receive the harp 12 and so that the harp 12 is capable of being selectively received at various positions along the body 22 of the harp 12. The harp support member 96 is fixed in the desired position by a connector 112.

Figure 7:
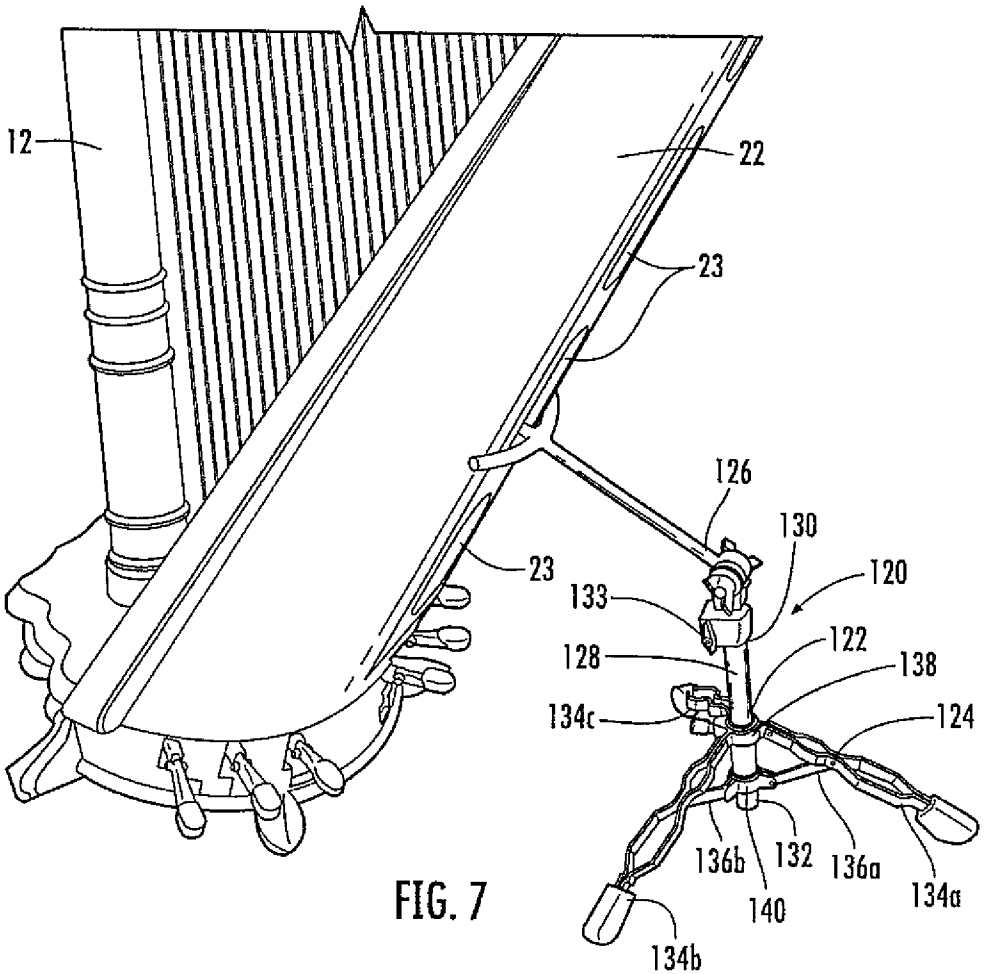
FIG. 7 is another embodiment of a harp support assembly constructed in accordance with the present invention.
Figure 8:
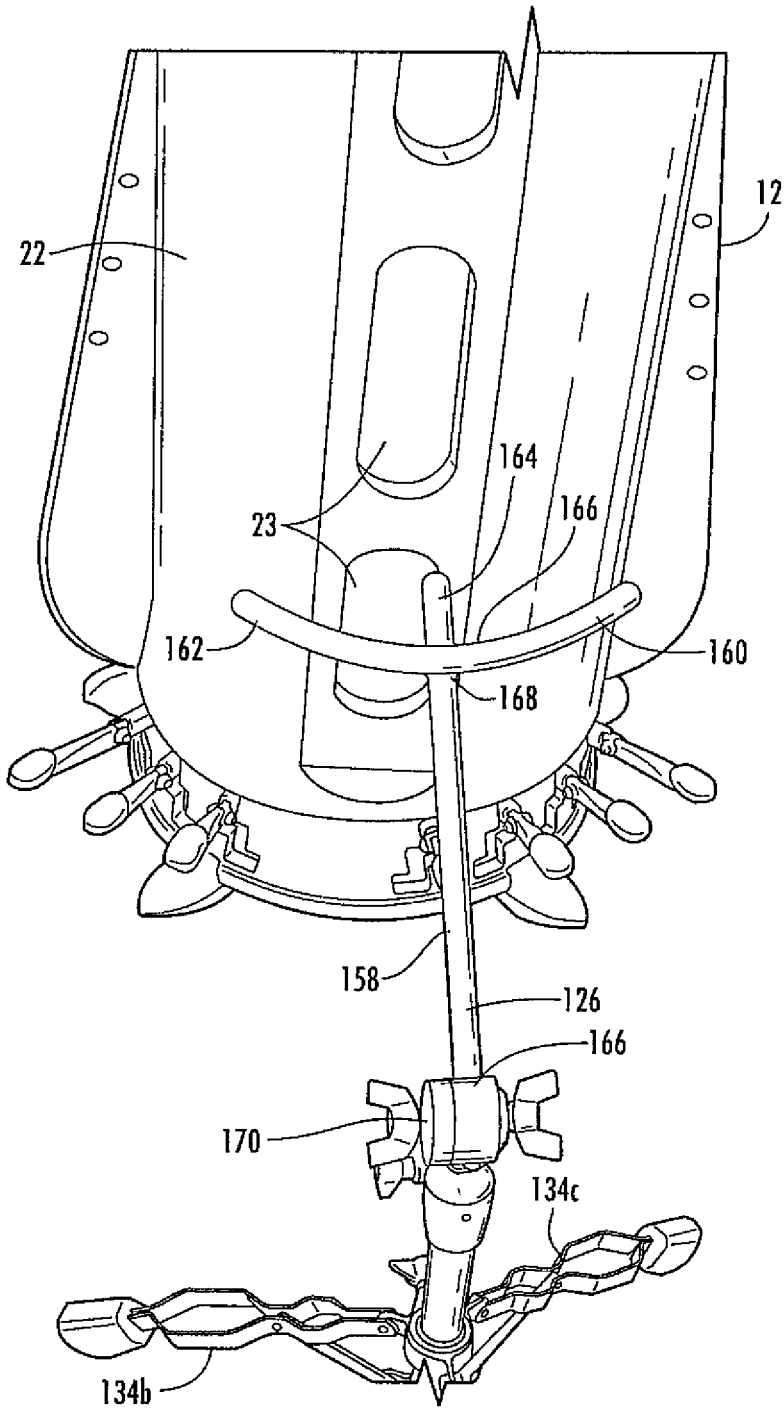
FIG. 8 is a perspective view of the harp support assembly of FIG. 7 positioned behind the harp.
Figure 9:
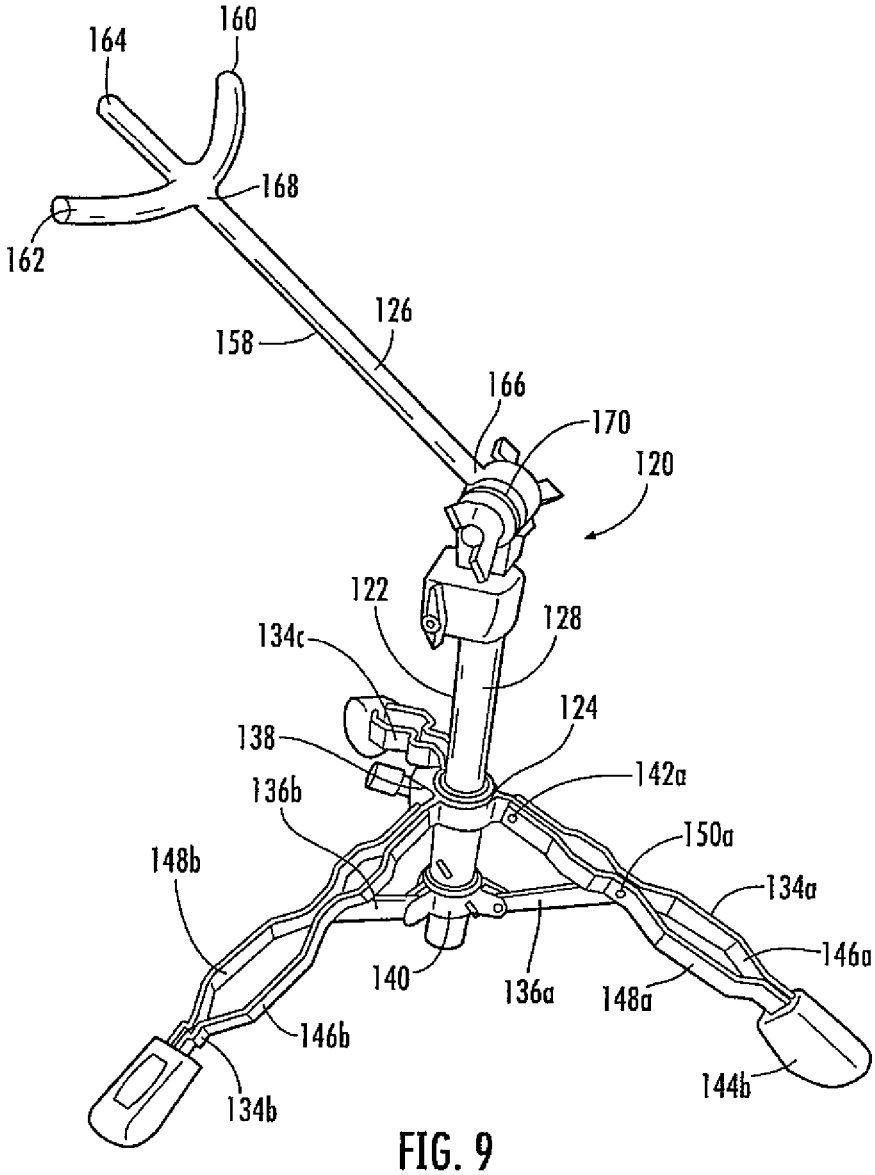
FIG. 9 is a perspective view of the harp support assembly of FIG. 7.

Referring to FIGS. 7-9, another embodiment of a harp support assembly 120 is shown. The harp support assembly 120 includes a post assembly 122, a base assembly 124 and a harp support member 126. The post assembly 122 includes a rod 128 having a first end 130 and a second end 132. The rod 128 is movable between a first position in which the rod 128 moves away from the surface and a second position in which the rod 128 moves toward the surface. The rod 128 is movable to a desirable position and/or adjustable to various heights as selected by the harpist 11. The rod 128 is shown fixed by a connector 133. It should be understood by one of ordinary skill in the art that the rod 128 may be fixed in position in any of a variety of ways known in the art for fixing an object in place so long as it functions in accordance with the present invention as described herein.

The base assembly 124 is positioned near the second end 132 of the rod 128 of the post assembly 122. The base assembly 124 includes a plurality of legs 134 (134*a*, 134*b*, and 134*c*), a plurality of arms 136 (136*a*, 136*b* and 136*c*), a first attachment member 138 and a second attachment member 140. Each of the plurality of legs 134 has a first end 142, a second end 144, and a first portion 146 and a second portion 148 provided in a substantially eight-shaped configuration. Each first end 142 of each of the plurality of legs 134 are connected to the first attachment member 138 in a tripod configuration. Although it should be understood by one of ordinary skill in the art that the plurality of legs 134 may be provided in any number and any variety of configurations, such as square, rectangular, circular, and the like, so long as the plurality of legs 134 functions in accordance with the present invention as described herein. Further, it should be understood that although the harp support assembly 120 is discussed having first and second attachment member 134 and 136, the harp support assembly 120 may be configured to have at least one attachment member. The first attachment member 138 is disposed about the rod 128 and axially positions and simultaneously attaches each of the plurality of legs 134 to the rod 128. The base assembly 124 is adjustable to position the harp support assembly 120 at various heights as desired by a harpist.

The first attachment member 138 is joined with the first end 142 of each of the plurality of legs 134 by respective pivot pins, such that each of plurality of legs 134 can pivot freely inwardly and outwardly with respect to the rod 128. The first attachment member 138 is disposed about the rod 128 and is capable of being moved along and about the rod 128 allowing the spread of each of the plurality of legs 134 and also enables the plurality of legs 134 to be folded inward after use of the harp support assembly 120. The plurality of legs 134 are selectively movable between an open position in which the plurality of legs 134 are spaced apart and a closed position in which the plurality of legs 134 are adjacent one another. A set screw is provided between the first attachment member 138 and the rod 128 for axial adjustment and fixing purposes.

One end 150 (150*a*, 150*b* and 150*c*) of each of the plurality of arms 136 is pivotally connected to a portion of a corresponding leg 134 of the plurality of legs 134. The other end 152 (152*a*, 152*b*, 152*c*) of each of the plurality of arms 136 is pivotally connected to the second attachment member 140 with a pin. The second attachment member 140 which is disposed about the rod 128 axially positions each of the plurality of arms 136 to the rod 128 with the first attachment member 138 and each of the plurality of legs 134 which corresponds to each of the plurality of arms 136. The second attachment member 140 is capable of being slid along the rod 128.

The harp support member 126 includes an extension member 158, a first support arm 160, a second support arm 162 and a stabilizing member 164. The extension member 158 has a first end 166 and a second end 168 such that the first end 166 of the extension member 158 is rotatably connected to the first end 130 of the rod 128. The extension member 158 of the harp support member 126 is shown rotatably connected to the rod 128 with a connector 170, however, it should be understood by one of ordinary skill in the art that the extension member 158 may be connected to the rod 128 by any method known in the art for connecting one thing to another. The harp support member 126 is rotatably movable between a first direction in which the harp support member 126 is moved toward the surface and an opposing second direction in which the harp support member 126 is moved away from the surface. The connector 170 fixes the harp support member 126 in the selected position. It should be understood by one of ordinary skill in the art that although the harp support member 126 is shown herein to be connected to a post assembly 122 and a base assembly 124, the harp support member 126 may be configured to be mounted alone to a bench, chair or some other such support apparatus so as to be used by a harpist for supporting a harp as described herein.

The first and second support arms 160 and 162 are substantially spaced apart in a semi-circular-shaped configuration which provides a harp receiving space 166. It should be understood by one of ordinary skill in the art that although the harp support member 126 is shown in a semi-circular shape, any shape may be utilized for receiving the harp 12, such as u-shaped, v-shaped, semi-spherical, semi-triangular, semi-square and the like, so long as the configuration of the harp support member 126 functions in accordance with the present invention as described herein. The first and second support arms 160 and 162 of the harp support member 126 may be coated or made from rubber or some other elastomeric material which allows the harp support member 126 to come in contact with the harp 12 without damaging the harp 12.

The stabilizing member 164 extends into the harp receiving space 166 from a portion of the first and second support arms 160 and 162 or the extension member 158 so as to stabilize the harp 12 when the harp 12 is positioned in the harp receiving space 166. The stabilizing member 164 may vary in length depending on the size of harp 12. The stabilizing member 164 of the harp support member 126 may be coated or made from rubber or some other elastomeric material which allows the harp support member 126 to come in contact with the harp 12 without damaging the harp 12.

Figure 10:
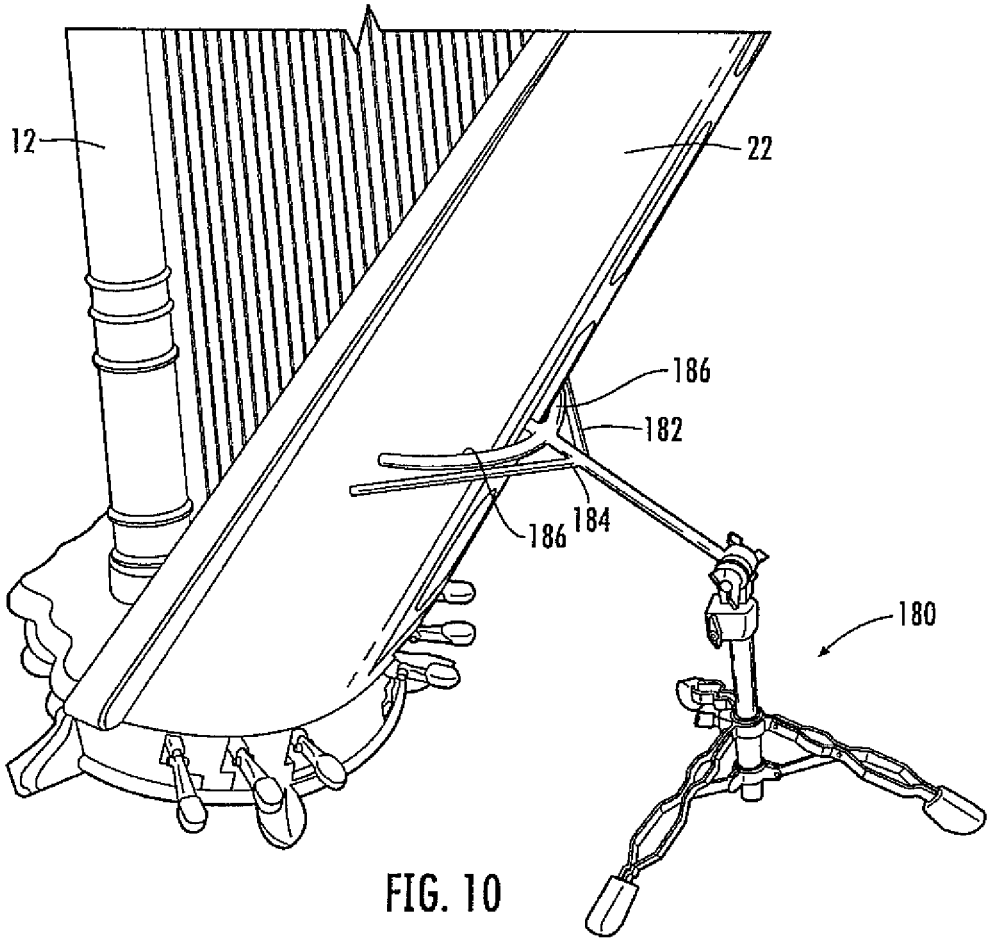
FIG. 10 is another embodiment of a harp support assembly constructed in accordance with the present invention.

Referring now to FIG. 10, another embodiment of a harp support assembly 180 is shown constructed in accordance with the present invention similar to the harp support assembly 120 except that the harp support assembly 180 includes a frame member 182 having at least one brace member 184 having a v-shaped configuration. It should be understood by one of ordinary skill in the art that although the at least one brace member 184 is shown having a v-shaped configuration, any shaped configuration may be utilized such as semi-circular, semi-spherical, semi-triangular, semi-square and the like, so long as the configuration of the at least one brace member 184 functions in accordance with the present invention as described herein. The at least one brace member 184 is positioned about a harp support member 186 so as to provide additional support to the harp support member 186 when the harp 12 is positioned in a harp receiving space 188 of the harp support member 186.

In use of the harp support assembly 10, the post 36 of the post assembly 30 is positioned perpendicular to the ground between the legs of the harpist 11. The first and second attachment members 54 and 56 are moved along the post 36 which moves each of the plurality of legs 50 and pivots each corresponding arm 52 to a position and desired height below the height of the knee of the harpist 11. A screw is then tightened for fixing the first and second attachment members 54 and 56 to provide the desired height of the harp support member 80. The harpist 11 tilts the harp 12 and pivots the harp support member 80 such that a portion of the body 22 of the harp 12 is positioned in the harp receiving space 88 and the harp support member 80 is fixed in the desired playable position.

In use of the harp support assembly 120, each of the plurality of legs 134 is opened in an expanded position. The harp support assembly 120 is positioned in between the legs of the harpist 11. The rod 128 is positioned to the desired height by the harpist 11 and fixed. The harp support member 126 is rotated to the desired positioned. The harp 12 is tilted toward the harpist 11 in a playable position such that the harp 12 is positioned in the harp receiving space 166 and the stabilizing member 164 is disposed into one of the openings 23 of the harp 12. The harp support assembly 120 may be moved into a collapsible position. In the collapsible position, the first and second attachment members 138 and 140 are slid along the rod 128 in a position so that the plurality of legs 134 are collapsed. Each component of the harp support assembly 120 may be detachable connected if so desired by the harpist. The collapsed harp support assembly 120 is easier for the harpist 11 to carry. A bag may be provided for storing and transporting the harp support assembly 120.

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed.

What is claimed is:

1. A harp support assembly for providing support to a portion of a conventional harp, the harp support assembly comprising:

a post having a first end and a second end;

a plurality of legs connected to a portion of the post, the plurality of legs connected for positioning the harp support assembly on a surface; and a harp support member connected to the second end of the post, the harp support member having at least one support arm providing a harp receiving space to receive the harp.

2. The harp support assembly of claim 1 wherein the post is extendible.

3. The harp support assembly of claim 2 wherein an extension member is removably connected to the post such that extension member is extendible from the post so that a harpist extends the extension member to a desired height.

4. The harp support assembly of claim 1 wherein the plurality of legs are selectively movable between an open position in which the plurality of legs are spaced apart and a closed position in which the plurality of legs are adjacent one another.

5. The harp support assembly of claim 1 wherein the at least one support arm of the harp support member has a first gripping arm and a second gripping arm in a substantially spaced apart configuration which provides a harp receiving space, the first and second gripping arms are pivotal about a pivot pin such that a biasing member acts to bias the first and second gripping arms so that the first and second gripping arms grip the harp when positioned in the harp receiving space.

6. The harp support assembly of claim 1 wherein the harp support member is extendible.

7. The harp assembly of claim 6 wherein the harp support member is provided with an extension member, the extension member of the harp support member being connected to the post such that the harp support member is movable between a first direction in which the harp supports member is moved toward the surface and an opposing second direction in which the harp support member is moved away from the surface.

8. The harp support assembly of claim 1 wherein the harp support member is provided with a stabilizing member which extends into a portion of the harp receiving space from a portion of the at least one support arm so as to stabilize the harp by disposing the stabilizing member into an opening of a body of the harp when the harp is positioned in the harp receiving space.

9. The harp support assembly of claim 8 wherein a portion of the stabilizing member is formed from an elastomeric material.

10. The harp support assembly of claim 1 wherein the harp support assembly further comprises:

a frame member having at least one brace member positioned about the harp support member so as to provide additional support to the harp support assembly when the harp is positioned in the harp receiving space.

11. The harp support assembly of claim 1 wherein at least a portion of the at least one support arm is formed of an elastomeric material.

12. A method for supporting a harp in a playable position, comprising the steps of:

providing a harp support assembly, comprising:

a post having a first end and a second end;

a plurality of legs connected to a portion of the post, the plurality of legs connected for positioning the harp support assembly on a surface; and a harp support member connected to the second end of the post, the harp support member having at least one support arm providing a harp receiving space to receive the harp;

positioning the harp support assembly behind a harp; and selectively moving the harp toward a shoulder of a harpist so that the harp is positioned in the harp receiving space of the harp support member.

13. The method of claim 12 further comprising the step of:

selectively moving the post between a first position in which the post moves away from the surface and a second position in which the rod moves toward the surface so that a desired height for positioning the harp receiving space is obtained for receiving the harp.

14. The method of claim 12 further comprising the step of:

selectively moving the plurality of legs between an open position in which the plurality of legs are spaced apart and a closed position in which the plurality of legs are adjacent one another.

15. The method of claim 12 further comprising the step of:

selectively moving the extension member such that the harp support member is movable between a first direction in which the harp support member is moved toward the surface and an opposing second direction in which the harp support member is moved away from the surface.

16. The method of claim 12 further comprising the steps of:

providing a stabilizing member to the harp support assembly which extends into the harp receiving space from a portion of the at least one support arm so as to stabilize the harp;

positioning the harp in the harp receiving space of the harp support member; and positioning the stabilizing member into an opening of a body of the harp so as to stabilize the harp.

17. The method of claim 12 wherein at least a portion of the harp support member is formed of an elastomeric material.

18. The method of claim 12 wherein the harp support assembly further comprises:

a frame member having at least one brace member positioned about the harp support member so as to provide additional support to the harp support assembly when the harp is positioned in the harp receiving space.

19. The method of claim 12 wherein the at least one support arm of the harp support member has a first gripping arm and a second gripping arm in a substantially spaced apart configuration which provides a harp receiving space.

20. The method of claim 19, further comprising the step of:

moving the first and second gripping arms such that a biasing member acts to bias the first and second gripping arms so that the first and second gripping arms grip the harp when positioned in the harp receiving space.

* * * * *